US007490444B2

(12) United States Patent
Nowack

(10) Patent No.: US 7,490,444 B2
(45) Date of Patent: Feb. 17, 2009

(54) BUILDING ELEMENT

(76) Inventor: Peter Nowack, Obererle 93, Gelsenkirchen (DE) 45879

( * ) Notice: Subject to any disclaimer, the term of this patent is extended or adjusted under 35 U.S.C. 154(b) by 704 days.

(21) Appl. No.: 10/495,311

(22) PCT Filed: Aug. 23, 2002

(86) PCT No.: PCT/EP02/09413

§ 371 (c)(1),
(2), (4) Date: Feb. 28, 2005

(87) PCT Pub. No.: WO03/029576

PCT Pub. Date: Apr. 10, 2003

(65) Prior Publication Data

US 2005/0166539 A1 Aug. 4, 2005

(30) Foreign Application Priority Data

Sep. 22, 2001 (DE) ..... 101 46 755

(51) Int. Cl.

| | |
|---|---|
| ***E04D 5/00*** | (2006.01) |
| ***E04D 12/00*** | (2006.01) |
| ***E04B 7/00*** | (2006.01) |
| ***E04B 1/00*** | (2006.01) |
| ***B32B 19/00*** | (2006.01) |

(52) U.S. Cl. ..... 52/411; 52/404.1; 52/408; 52/443; 52/506.01; 52/782.1; 52/793.1; 428/339; 428/221; 428/304.4; 428/411.1

(58) Field of Classification Search ..... 52/404.1, 52/411, 443, 506.01, 782.1, 793.1, 660, 408, 52/406.2, 407.5; 428/339, 221, 304.4, 411.1
See application file for complete search history.

(56) References Cited

U.S. PATENT DOCUMENTS

| | | | | |
|---|---|---|---|---|
| 2,018,911 | A * | 10/1935 | Brill et al. | 52/232 |
| 2,312,987 | A * | 3/1943 | Grassick | 52/789.1 |
| 3,734,813 | A * | 5/1973 | Pohl | 428/162 |

(Continued)

FOREIGN PATENT DOCUMENTS

JP 10266386 A * 10/1998

*Primary Examiner*—Jeanette Chapman
(74) *Attorney, Agent, or Firm*—Jones & Smith, LLP; John Wilson Jones

(57) ABSTRACT

The invention relates to a building element for erecting internal walls, outer walls and or ceilings or roofs, preferably flat or slightly slanted roofs of a building, consisting of an insulating layer forming an insulating core made of mineral fibers bound by a binding agent, especially rock wool fibers and/or glass wool fibers bound with a synthetic resin, and at least one preferably metal covering layer which is disposed on a large surface of the insulating layer. An adhesive layer is placed between the covering layer and the insulating layer and used to glue the covering layer to the insulating layer. In order to further develop said type of building element so that it is easy to handle when said building elements are manufactured at the end of a continuous manufacturing process, while at the same time provided high protection against fire so that the building elements can also be used for roofs with larger angles of inclination, the layer (5) consists of a first quick binding adhesive and a second adhesive which is effective during the direct effect of fire at temperatures of up to and exceeding 1,0000° C., said adhesives arranged in separate areas (6, 7) of the layer (5).

20 Claims, 2 Drawing Sheets

Figure 1:
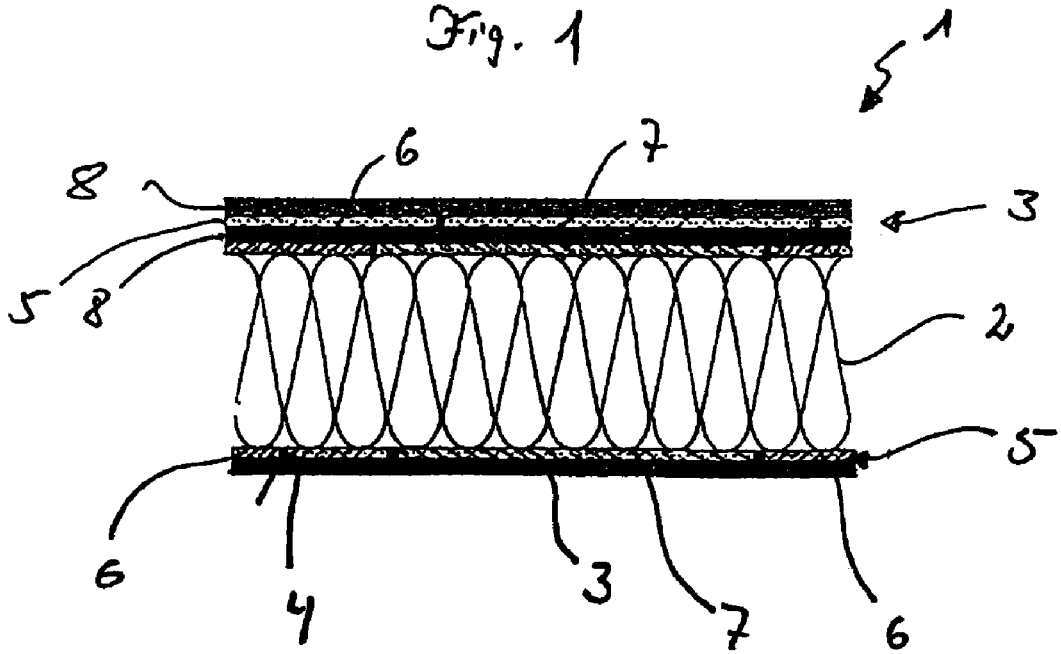

U.S. PATENT DOCUMENTS 4,199,645 A * 4/1980 Schwarz ..... 428/339
4,705,715 A * 11/1987 DeCoste et al. ..... 442/151
6,061,993 A * 5/2000 Bendixen et al. ..... 52/783.19
6,218,005 B1 * 4/2001 Moh ..... 428/343
6,511,730 B1 * 1/2003 Blair et al. ..... 428/73
6,579,586 B1 * 6/2003 Fay et al. ..... 428/40.1

* cited by examiner

BUILDING ELEMENT

This invention relates to a building element for erecting inner walls, outer walls and/or ceilings or roofs, preferably flat or slightly slanted roofs of a building, said building element consisting of an insulating core-forming insulating layer made of mineral fibers, particularly rock wool and/or glass wool fibers bound by a binding agent, and at least one preferably metallic covering layer arranged on a large surface of the insulating layer, with a layer of an adhesive being applied between the covering layer and the insulating layer to glue said covering layer to said insulating layer.

Building elements of this type are known from prior art and are also named sandwich elements. Sandwich elements with metallic covering layers and a non-inflammable insulating core, for example made of rockwool, are known on the market today in a great number of variants.

But there are also known other sandwich elements with covering layers made of GFK (glass fiber reeinforced synthetic material), wooden materials, glass etc. having their covering layers glued to the insulating layer by means of polyurethane adhesives. Due to these polyurethane adhesives which are used as a rule for connecting the insulating core to the covering layers, these sandwich elements cannot be classified in building material class A (non-inflammable), so that the same only meet the requirements of building material class B1 (hardly inflammable).

Sandwich elements of this type are also formed with an insulating core made of polyurethane (PUR) likewise classified in building material class B1, so that it is not readily recognizable to the users of these building elements which are the advantages of building elements with an insulating core made of fiber insulating materials. Accordingly, different from sandwich elements having a core made of fiber insulating materials sandwich elements with an insulating core made of polyurethane are not suitable for fire proofing solutions classified F30-F120. Sandwich elements with an insulating core made of mineral fibers, especially rock wool, have meanwhile been successfully tested plural times up to fire classification F120.

To attain classification in building material class A, German Industrial Standard DIN 4102, part 1 requires that the building product passes both the standardized fire shaft test and the standardized furnace test or the determination of the lower gross calorific value. Additionally, the building product is tested for its smoke releasing behaviour.

Organic adhesives on a polyurethane basis have shown to be suitable for the manufacturing of sandwich elements with an insulating core made of rock wool and with covering layers made of sheet metal plates. The single or two-package systems on an organic basis that are used ensure the required bonding between the insulating core and the covering layers. Besides mineral fibers blown mineral pre-materials such as perlite are used as an insulating material for the insulating core. Also building material plates on the basis of gypsum and cement are occasionally installed for the protection of a non-temperature resistant insulating core between the covering layer and the insulating core.

The above-described sandwich elements have proven worthwhile for use in a vertical orientation. However, in ceiling constructions or slanted constructions it can be seen during the fire test that in sandwich elements of this type the covering layer facing the source of fire separates from the insulating core already after a short time. The reason therefor is that the lacking temperature resistance of the organic adhesive leads to that this adhesive softens already at a temperature from 100 to 150° C. and burns at higher temperatures, so that the bonding between the insulating core and the covering layer is dissolved, allowing the covering layer to deform in such a manner that any fire-proved connection between the individual sandwich elements e.g. forming a covering surface is no longer given. This results in a increased temperature break-down, particularly in the region of the joints.

Therefore, instead of organic adhesives one has used inorganic adhesives which can be exposed to temperatures higher than 1000° C. Although these adhesives improve the long-term stability in fire proofing elements in horizontal or slanted constructions, the same can, owing to the long curing time and the added amounts of water, be used only to a limited extend in the building elements herein described, because they allow for a continuous manufacturing in a continuous twin-belt installation only to some extent. Namely, the primary aspect in an efficient continuous production is that the manufactured building elements are available for use as quickly as possible after the connection of their components, i.e. their insulating core and covering layer. The long curing times of the inorganic adhesives that are for example based on water glass stand in the way of their quick availability for further handling. Neither adhesives on the basis of gypsum or cement are an alternative to the afore-mentioned adhesives, since in this case, too long curing times of the adhesive must be accepted.

If building elements glued in this manner are lifted up too early, there will be a considerable risk that some or even a greater number of adhering spots become separated which detrimentally affects the final strength of such building elements.

Accordingly, it is a problem of the present invention to further develop said type of building element so that the same is quickly available for further handling at the end of a continuous manufacturing process, while offering a high degree of fire protection, so that the building elements can be installed also in the roof area with larger angles of inclination.

The solution of this problem provides that in this type of building element the layer consists of a first, quick-binding adhesive and a second adhesive which is effective during the direct influence of fire at temperatures of up to and exceeding 1000° C., which adhesives are provided in areas of the layer that are separated from each other.

Accordingly, the connection between the insulating core and the covering layer is obtained by both an organic adhesive providing for a quick connection, i.e. glueing between the insulating core and covering layer and an inorganic adhesive which guarantees a high degree of fire protection, the slow curing of the inorganic adhesive with view to quick availability for use after the manufacturing process being compensated for by the quick-curing organic adhesive, and the lacking fire resistance of the organic adhesive being replaced by the high fire resistance of the inorganic adhesive. In addition, both adhesives are arranged in areas separated from each other, so that the adhesives cannot chemically influence each other, on one side and can be arranged in those areas which are particularly suited for the respective function of the adhesive, on the other side.

Further features and advantages of the present invention will become apparent from the subclaims and are discussed in more detail in the following.

For manufacturing a non-inflammable building element with metallic covering layers and an insulating core made of rock wool insulation panels with most narrow thickness tolerances may be used today. Smooth metallic covering layers in the form of sheets guarantee full-surface contact with the normally non-laminated non-inflammable insulating core made of rock wool fibers. When using profiled sheets (geometry of beads, microlines, microstructures) it is advantageous to form the distance between the covering layer and the surface of the insulating core so that it will not exceed 1.1 mm in any place.

Such building elements provide for additional possibilities of use in building construction, particularly factory hall construction, which has not been possible up today because of the classification in building material class B1. With the building element according to the invention there can be made for example non-inflammable separation walls or facades, fire walls, block unit separation walls and non-inflammable roof constructions.

The combination of said two adhesives accordingly leads to a quick bonding between said two material levels of the insulating core on one side and the covering layer on the other side or between the insulating core and a fire plate arranged under the covering layer, thereby making economic manufacturing of the building elements possible. The second adhesive guarantees the bonding between the layers when directly exposed to fire at temperatures of up to an exceeding 1000° C. and is effective particularly in the installed condition of the building element.

The different adhesives may be applied to the covering layers or to the core to be glued to them in the form of caterpillars or drops next to each other by means of a spraying or roll method.

Adhesives on a single or multi-package basis have shown to be suitable organic adhesives. The inorganic portion of the adhesive is formed by adhesives which can resist the high temperature requirements of a fire test up to and exceeding 1000° C. and which as a rule are based on water glass, cement, gypsum or the like.

The individual components of the building element are put together after having applied the adhesive and are cured by supplying heat in a continuous or discontinuous system. In a normally heated twin-belt system or in a normally heated press it is the organic adhesive to first react within a short time. Here, water-curing single-package adhesives benefit from the water-containing inorganic adhesive which is used in parallel during the curing process. Thanks to the very short curing process of the organic adhesive the building elements can be removed from the production line either manually or by a machine already a short time after the curing of the organic adhesive and can be used further in the usual way. The inorganic adhesive completely cures during the subsequent intermediate storage of the building elements until their delivery. By this time the building element will have reached its maximum strength.

Despite the use of an inorganic adhesive the building elements which are manufactured in this way are available for further use already after a short time, without changing and particularly decelerating the production flow of the continuous or discontinuous production process.

In the fire test and in real fires only the organic adhesive will dissolve or burn. The inorganic adhesives will guarantee the required bonding between the covering layers and the insulating core or between the covering layers and fire plates arranged on the insulating core also at temperatures of up to and exceeding 1000° C., wherein a corresponding arrangement of two adhesives can of course be provided also between said fire plates and the insulating core. Therefore, such building elements can be worked up not only in a vertical orientation but also in an inclined orientation in the building, so that also roof constructions can be made with these building elements.

The above-described building elements may also include covering layers having a profiled surface. In such types of building elements it has shown to be advantageous that in the areas in which cavities to the insulating core are produced by applying the profiled covering layer, foaming organic adhesives are used, while the areas of the covering layers which are directly adjacent to the insulating core are glued to the insulating core by means of the inorganic non-inflammable adhesive.

The construction of a building element according to the invention additionally offers the advantage of improving the long-term stability of such a building element, so that rapid aging which is recognized in prior art building elements and particularly in the connection between the insulating core and the covering layers does not occur, thereby avoiding the loss of overall strength. In addition, with the building element according to the invention the bonding between critical surfaces, for example between extremely smooth or oxidized surfaces of the covering layers can be improved.

Figure 2:
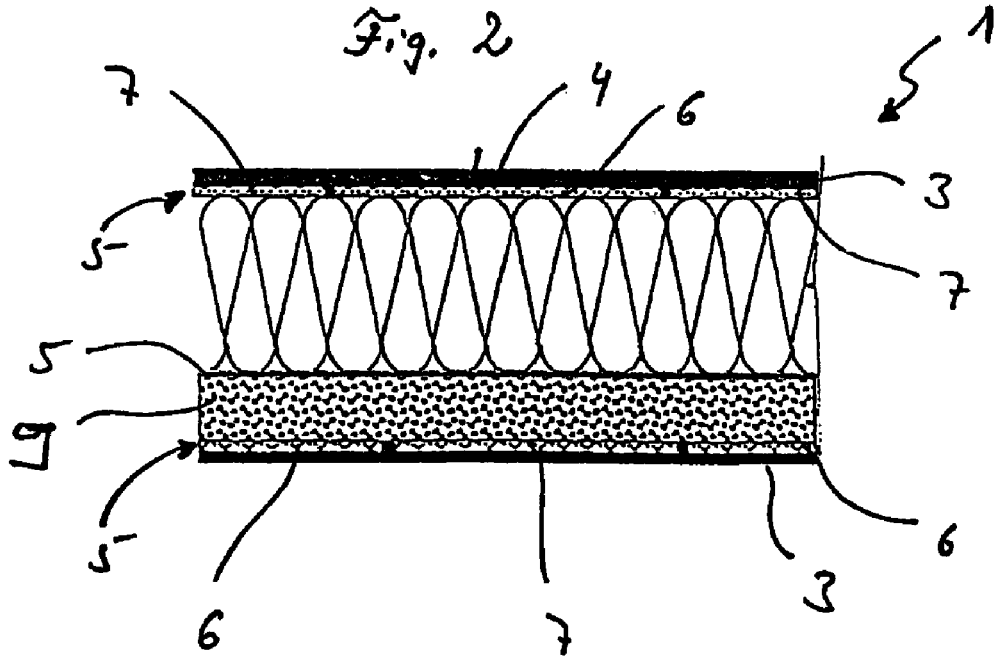
Figure 3:
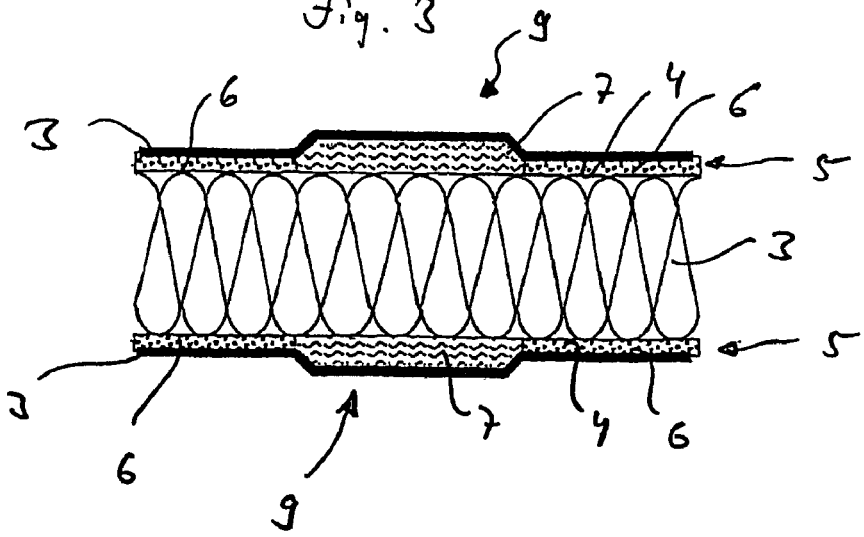
Figure 4:
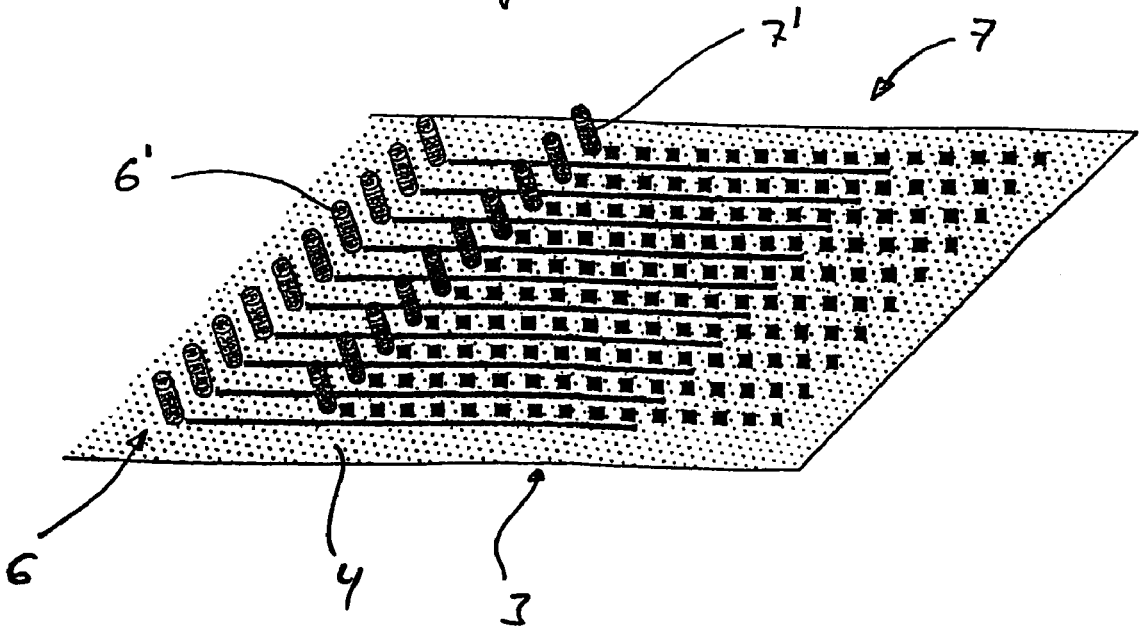

Further features and advantages of the invention will become apparent from the following description of the attached drawing showing preferred embodiments of a building element in a sectional side view. In the drawing it is shown by:

FIG. 1 a part of a first embodiment of a building element represented in a sectional side view;

FIG. 2 a part of a second embodiment of a building element represented in a sectional side view;

FIG. 3 a part of a third embodiment of a building element represented in a sectional side view; and FIG. 4 a part of a surface of an insulating core of the building element according to FIGS. 1 to 3, with adhesives arranged thereon.

A building element 1 as shown in the FIGS. 1 to 3 for the erection of inner walls, outer walls and/or ceilings or roofs, preferably flat or slightly slanted roofs of a building consists of an insulating core-forming insulating layer 2 made of mineral fibers bound by a binding agent, in particular rock wool and/or glass wool fibers bound by an artificial resin, and at least one metallic covering layer 3 which is arranged on a large surface 4 of the insulating layer 2, with a layer 5 which consists of two different adhesives gluing said covering layer 3 to said insulating layer 2 being arranged between the covering layer 3 and the insulating layer 2.

Said layer 5 is divided in areas 6 and 7. In area 6 an organic adhesive is arranged which for example may be in the form of a quick-curing two-package polyurethane adhesive, whereas in area 7 an inorganic adhesive is arranged which is based on a mineral binding agent like water glass, cement, gypsum or the like, so that it is highly fire-resisting and guarantees the bond/connection between the covering layer 3 and the insulating layer 2 also at temperatures up to and over 1000° C., at least for a certain period of time.

The foaming organic adhesive is applied in area 6 over the full surface to the insulating layer 2 in a thickness of 1 mm, with approx 0.3 kg/m$^2$ being arranged on the insulating layer 2.

The insulating layer 2 consists of large-formate insulating panels. On each of the large surfaces 4 of insulating layer 2 are arranged a covering layer 3, of which the lower covering layer 3 is formed in a single-shell construction and the upper covering layer 3 is formed in a double-shell construction. Accordingly, the upper covering layer consists of two metal shells 8 which are glued to each other. Between metal shells 8 a layer 5 of two adhesives is arranged, with layer 5 corresponding to layer 5 between the lower covering layer 3 and the insulating layer 2.

A second embodiment of a building element 1 is shown by FIG. 2 and is different from the first embodiment according to FIG. 1 on one side by that a fire plate 9, e.g. a gypsum or cement-bound construction plate is arranged between the insulating layer and the lower covering layer 3 and on the other side by that the upper covering layer is formed in a single-shell construction.

This building element 1 includes three layers 5 of two adhesives which are divided in areas 6 and 7 corresponding to the embodiment according to FIG. 1. In these areas 6 respectively 7 there are again arranged an organic respectively an inorganic adhesive.

The building elements 1 described include covering layers 3 which are formed as smooth sheet layers. In FIG. 3 an embodiment with profiled sheet layers as covering layers 3 is shown, wherein said sheet layers include beads 9. Alternative profiles such as for example microlines or other microstructures can be used as well. In the area of the beads 9 the covering layer 3 has a larger distance to the insulating layer 2. In this area 6 the organic adhesive is arranged, whereas in area 7 between neighbouring beads 9 of a covering layer 3 an inorganic adhesive is arranged.

The sheet layers of said two covering layers 3 consist of metal plates which are galvanized and/or include a zinc alloy. Alternatively, said sheet layers may be in the form of a light alloy, particularly aluminium.

In the insulating layer 2 the fibers run substantially at right angles to the large surfaces 4.

In FIG. 4, the upper surface 4 of the insulating layer 2 is shown as a portion. It can be seen that the two adhesives are applied in a dot-shaped fashion to the areas 6 respectively 7. This dot-shaped application is represented by columns 6' respectively 7', with the columns 6' representing the organic adhesive and the columns 7' the inorganic adhesive.

The invention claimed is:

1. A building element for erecting inner walls, outer walls and/or ceilings or roofs, preferably slightly slanted roofs of a building, said element comprising an insulating core forming insulating layer comprising mineral fibers bound by an artificial resin, and at least one metallic covering layer that is arranged on the large surface of the insulating layer, with an adhesive layer interconnecting said covering layer and said insulating layer and arranged between the covering layer and the insulating layer, wherein the adhesive layer comprises a first, quick-binding adhesive and a second adhesive which is effective during the influence of fire at temperatures up to and exceeding 1000° C., which adhesives are arranged in areas of the layer that are separated from each other.

2. The building element according to claim 1, wherein the first adhesive is formed as an organic single layer or two-package adhesive.

3. The building element according to claim 1, wherein the second adhesive comprises at least one inorganic mineral binding agent selected from the group consisting of water glass, cement, and gypsum.

4. The building element according to claim 1, wherein the adhesive layer forms a full-surface coating on the insulating layer and/or an intermediate layer between the insulating layer and the covering layer.

5. The building element according to claim 1, wherein the areas first and second adhesives are arranged in an alternating fashion.

6. The building element according to claim 1, wherein the first adhesive is a foam.

7. The building element according to claim 1, wherein the insulating layer is comprised of large-formate mineral fiber boards.

8. The building element according to claim 1, wherein the first and second adhesives are applied in the form of drops and/or caterpillars.

9. The building element of claim 1, wherein the mineral fibers are selected from the group consisting of rock wool and/or glass wool fibers.

10. A building element for erecting inner walls, outer walls and/or ceilings or roofs said element comprising (i) an insulating core comprising rock wool and/or glass wool fibers bound by an artificial resin, (ii) at least one metallic layer covering the insulating core layer and (iii) an adhesive layer interconnecting the at least one metallic layer and the insulating core and comprising an organic adhesive and an inorganic adhesive wherein the organic adhesive and inorganic adhesive are located in separate areas of the adhesive layer and further wherein the inorganic adhesive is capable of adhering the insulating core layer and the at least one metallic layer at temperatures up to and exceeding 1000 °C.

11. The building element according to claim 10, wherein the inorganic adhesive comprises at least one mineral binding agent selected from the group consisting of water glass, cement, and gypsum.

12. The building element according to claim 10, wherein the organic adhesive and the inorganic adhesive are arranged in an alternating fashion.

13. The building element according to claim 10, wherein the organic adhesive is a foam.

14. The building element according to claim 10, wherein the at least one metallic layer covers the top layer of the insulating core and the bottom layer of the insulating core.

15. The building element according to claim 14, wherein the at least one metallic layer comprises a smooth sheet layer which further includes beads.

16. The building element according to claim 10, wherein the at least one metallic layer is galvanized or is comprised of a zinc or aluminium alloy.

17. A building element for erecting inner walls, outer walls and/or ceilings or roofs said element comprising (i) an insulating core comprising rock wool and/or glass wool fibers bound by an artificial resin, (ii) a first metallic layer covering the top layer of the insulating core and a second metallic layer covering the bottom layer of the insulating core; and (iii) an adhesive layer interconnecting the first and second metallic layers and the insulating core, the adhesive layer comprising a quick curing organic adhesive and a slow curing inorganic adhesive wherein the organic adhesive and inorganic adhesives are located in separate areas of the adhesive layer and wherein the inorganic adhesive is capable of adhering the insulating core and the top and bottom layers of the metallic layer at temperatures up to and exceeding 1000° C.

18. The building element according to claim 17, wherein the inorganic adhesive comprises at least one mineral binding agent selected from the group consisting of water glass, cement, and gypsum.

19. A building element for erecting inner walls, outer walls and/or ceilings or roofs, preferably slightly slanted roofs of a building, said element comprising an insulating core forming insulating layer comprising rock wool and/or glass wool fibers bound by an artificial resin, and at least one metallic covering layer that is arranged on the large surface of the insulating layer, with an adhesive layer interconnecting said covering layer and said insulating layer and arranged between the covering layer and the insulating layer, wherein the adhesive layer comprises a first, quick-binding foam adhesive and a second adhesive which is effective during the influence of fire at temperatures up to and exceeding 1000° C., which adhesives are arranged in areas of the adhesive layer and are separated from each other and further wherein the at least one metallic covering layer comprises sheet elements which are profiled and which include beads, the first foam adhesive being arranged in each area of the portion spaced from the insulating layer while in each area resting on top of the insulating layer a layer of the second adhesive is arranged.

20. The building element of claim 19, wherein the second adhesive is at least one inorganic component selected from the group consisting of water glass, cement and gypsum.

* * * * *